US010347957B2

(12) United States Patent
Raith et al.

(10) Patent No.: US 10,347,957 B2
(45) Date of Patent: Jul. 9, 2019

(54) HOLLOW CONDUCTOR SYSTEM COMPRISING AT LEAST TWO HOLLOW CONDUCTOR BUNDLES CONNECTED BY FIRST AND SECOND CONNECTING MEMBERS AND INCLUDING RESPECTIVE HOLLOW CONDUCTOR LINES AND CORRESPONDING VOIDS

(71) Applicant: Rohde & Schwarz GmbH & Co. KG, Munich (DE)

(72) Inventors: Andreas Raith, Prackenbach (DE); Markus Voegerl, Traitsching (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 0 days.

(21) Appl. No.: 15/719,034

(22) Filed: Sep. 28, 2017

(65) Prior Publication Data

US 2018/0090807 A1 Mar. 29, 2018

(30) Foreign Application Priority Data

Sep. 29, 2016 (EP) ..... 16191571

(51) Int. Cl.
*H01P 1/04* (2006.01)
*H01P 1/02* (2006.01)
(Continued)

(52) U.S. Cl.
CPC ..... *H01P 1/042* (2013.01); *H01P 1/02* (2013.01); *H01P 3/12* (2013.01); *H01P 5/024* (2013.01);
(Continued)

(58) Field of Classification Search
CPC .. H01P 3/12; H01P 1/022; H01P 5/024; H01P 11/003
(Continued)

(56) References Cited

U.S. PATENT DOCUMENTS 4,553,938 A 11/1985 Olsen
6,005,458 A * 12/1999 Buer et al. ..... H01P 1/042 333/248
(Continued)

FOREIGN PATENT DOCUMENTS

FR 2554904 A1 5/1985
FR 2958802 A1 10/2011
(Continued)

OTHER PUBLICATIONS

Extended European Search Report dated Mar. 31, 2017, issued in priority European Application No. 16191571.5 filed Sep. 29, 2016, 8 pages.

*Primary Examiner* — Benny T Lee
(74) *Attorney, Agent, or Firm* — Christensen O'Connor Johnson Kindness PLLC

(57) ABSTRACT

A hollow conductor system is described which comprises at least two hollow conductor bundles and at least two connecting members. Each hollow conductor bundle comprises at least two hollow conductors separated by each other via a common intermediate wall. Each connecting member connects one hollow conductor of one hollow conductor bundle with a corresponding hollow conductor of the other hollow conductor bundle such that a void is provided between the connecting member and the adjacent connecting member and/or an adjacent hollow conductor. Further, a method for assembling a hollow conductor system is described.

17 Claims, 1 Drawing Sheet

(51) Int. Cl.

| | |
|---|---|
| ***H01P 3/12*** | (2006.01) |
| ***H01P 11/00*** | (2006.01) |
| ***H01R 43/02*** | (2006.01) |
| ***H01R 4/60*** | (2006.01) |
| ***H01P 5/02*** | (2006.01) |

(52) U.S. Cl.
CPC ..... *H01P 11/003* (2013.01); *H01R 4/60* (2013.01); *H01R 43/02* (2013.01)

(58) Field of Classification Search
USPC ..... 333/1, 248, 254
See application file for complete search history.

(56) References Cited

U.S. PATENT DOCUMENTS

| | | | | |
|---|---|---|---|---|
| 2007/0270017 | A1* | 11/2007 | Hardacker et al. ..... | H01P 1/042 439/357 |
| 2009/0206961 | A1* | 8/2009 | Fujita ..... | H01P 1/042 333/254 |
| 2011/0133446 | A1 | 6/2011 | Nakayama | |

FOREIGN PATENT DOCUMENTS

| | | | |
|---|---|---|---|
| FR | 2988938 | A1 | 10/2013 |
| JP | S594301 | A | 1/1984 |
| JP | 2002009501 | A | 1/2002 |

* cited by examiner

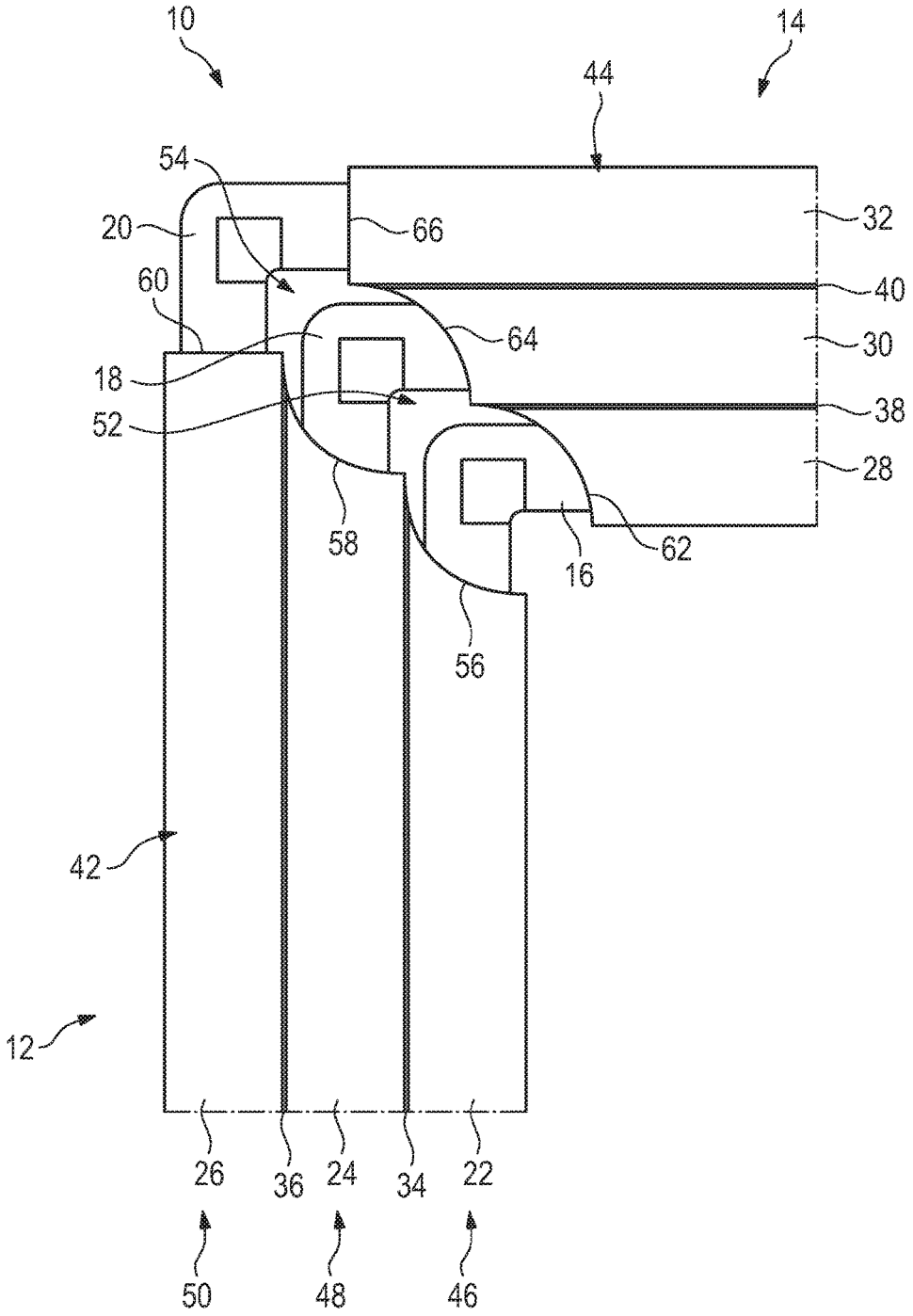
10
14
44
54
20
66
32
60
40
64
30
18
38
52
28
58
62
16
56
42
12
26
36
24
34
22
50
48
46

HOLLOW CONDUCTOR SYSTEM COMPRISING AT LEAST TWO HOLLOW CONDUCTOR BUNDLES CONNECTED BY FIRST AND SECOND CONNECTING MEMBERS AND INCLUDING RESPECTIVE HOLLOW CONDUCTOR LINES AND CORRESPONDING VOIDS

FIELD OF THE DISCLOSURE

The disclosure relates to a hollow conductor system and a method for assembling a hollow conductor system.

BACKGROUND OF THE DISCLOSURE

In general, a hollow conductor connecting member is used to connect two separately formed hollow conductors. Depending on its shape, the hollow conductor connecting member may have different characteristics. For instance, the hollow conductor connecting member can be an E-plane bend or an H-plane bend.

Usually, a hollow conductor connecting member is formed as a muffle, also called sleeve, wherein the hollow conductor connecting member has connecting portions which surround the hollow conductors wherein the hollow conductors may be formed rectangular. The hollow conductors and the hollow conductor connecting member placed between the hollow conductors establish a hollow conductor system which ensures that the electromagnetic waves propagating through the hollow conductors and the hollow conductor connecting member are transferred to a desired location.

Generally, hollow conductors are also called wave guides, hollow wave guides, rectangular wave guides, HF-wave guides, hollow-metallic wave guides, etc.

Such a hollow conductor system may be used in applications which typically have restricted available space for the hollow conductor system. In addition, a lightweight, cost-optimized and mechanically stable hollow conductor system is required which can be assembled easily.

Furthermore, the electrical losses during the transmission of electromagnetic waves have to be minimized by the hollow conductor system. Thus, an efficient hollow conductor is also required.

SUMMARY OF THE DISCLOSURE

Embodiments of the disclosure provide a hollow conductor system comprising at least two hollow conductor bundles and at least two connecting members wherein each hollow conductor bundle comprises at least two hollow conductors separated by each other via a common intermediate wall wherein each connecting member connects one hollow conductor of one hollow conductor bundle with a corresponding hollow conductor of the other hollow conductor bundle such that a void is provided between the connecting member and the adjacent connecting member and/or an adjacent hollow conductor.

Embodiments of the disclosure are based on the finding that a lightweight hollow conductor system can be provided as several hollow conductors are combined in a hollow conductor bundle wherein the different hollow conductors of each hollow conductor bundle are interconnected by the connecting members such that several hollow conductor lines are established. The weight of the hollow conductor system is further reduced by the void provided between one connecting member and the adjacent connecting member and/or an adjacent hollow conductor. Furthermore, the void ensures better electrical properties as the electrical losses are minimized due to the different materials adjoining each other, in particular air as well as the material of the hollow conductor bundles. Furthermore, a compact design is provided as the hollow conductors of each hollow conductor bundle are directly connected with each other via the intermediate walls. This also improves the mechanical stability of the whole hollow conductor system.

Each hollow conductor is composed of walls encompassing a space that is used for conducting electromagnetic waves. The hollow conductor bundle is composed of at least two hollow conductors orientated substantially parallel to each other wherein these hollow conductors share a common intermediate wall. Accordingly, this common intermediate wall encompasses the spaces partly simultaneously.

The common intermediate wall extends substantially in the propagation direction of the electromagnetic waves propagating through the spaces defined by the hollow conductors. Accordingly, the hollow conductors of the same hollow conductor bundle separated from each other by the common intermediate wall are arranged adjacent to each other in a gapless manner.

Accordingly, the common intermediate wall confines the space of both hollow conductors of the same hollow conductor bundle partly in order to ensure that the electromagnetic waves cannot exit the hollow conductors inadvertently due to the common intermediate wall.

Each connecting member connects two respective hollow conductors of the hollow conductor bundles to ensure a hollow conductor line. Thus, the hollow conductor line is defined by a first hollow conductor of the first hollow conductor bundle, the connecting member and the first hollow conductor of the second hollow conductor bundle connected to the first hollow conductor of the first hollow conductor bundle via the connecting member. This hollow conductor line ensures that the electromagnetic waves can be transferred from one point to another point.

According to an aspect, the connecting members are connected to the hollow conductors at their face sides. The hollow conductor system can be established easily since the separately formed parts are connected to each other at their dedicated ends, in particular the face sides of the hollow conductors. The face side corresponds to the front of the appropriate hollow conductor.

According to another aspect, the connecting member is inserted into the hollow conductors such that the hollow conductors surround the connecting member at least partly. A mechanically stable connection is provided since the connecting members are guided within the corresponding hollow conductors. Moreover, the total size is reduced as the area of the cross section of the connecting member is smaller than the one of the hollow conductors connected to the connecting member.

Furthermore, at least one hollow conductor may have an inclined face side with respect to its axial direction. The axial direction of the hollow conductor corresponds to the propagation direction of the electromagnetic waves transmitted via the hollow conductors. The inclined face side ensures that the connecting member is received by the hollow conductor in a certain manner providing different electromagnetic properties. For instance, the shielding properties are improved due to the inclined face side which in turn has a positive effect on the electrical losses. Additionally, the mechanical stability of the hollow conductor system is improved, in particular regarding bending stresses.

According to another aspect, a connection line is provided between each connecting member and the hollow conductor connected to the corresponding connecting member. The connection line ensures that the connecting member is fixedly connected with the hollow conductor bundle comprising the corresponding hollow conductor bundle. For instance, the connection line is a welding seam or a soldered seam. Alternatively, a detachable connection is provided wherein the connection line is provided by the transition line between the hollow conductor and the connecting member being inserted into the hollow conductor. The connection line is used for joining the connecting member and the hollow conductor.

In some embodiments, the connection line encloses the complete area of the cross section of the connecting member. As the connecting member is inserted, the connection line is provided at the outer surface of the connecting member. In other words, the connection line encircles the complete connecting member.

For instance, at least one connection line is inclined with respect to the cross section of at least one hollow conductor. As the face side of at least one hollow conductor is inclined, the corresponding connection line is also inclined with respect to the cross section of the dedicated hollow conductor. Thus, the connection line is inclined with respect to the axial direction which means that the connection line has an angle being different to 0° and 90°.

In some embodiments, the connection line is curved.

The connection line may run toward the void. The void is established between the connecting member and the adjacent connecting member as well as the adjacent hollow conductors. Thus, the face side of the hollow conductor is inclined such that more material of the hollow conductor is provided in the area adjoining the neighbored hollow conductor of the same hollow conductor bundle, in particular the outwardly positioned neighbored hollow conductor if the connecting member has a bent shape. This design has a positive effect on the electromagnetic properties, for instance the shielding properties. Hence, the electrical losses are minimized wherein the weight of the hollow conductor system is reduced, simultaneously.

According to another aspect, each hollow conductor bundle comprises at least three hollow conductors wherein at least three connecting members are provided such that at least two voids are provided between each neighbored connecting members. A multi beam hollow conductor system can be established easily with a small amount of parts as only two hollow conductor bundles are provided as well as the corresponding connecting members. Since the hollow conductor bundles each comprise several hollow conductors in a bundled manner, a very compact design is established wherein the manufacturing and assembling efforts are reduced with regard to the complexity of the hollow conductor system.

In some embodiments, the connecting member has a right-angled shape. The connecting member may be a muffle, in particular an H-plane bend or an E-plane bend.

Additionally, the void may have a generally triangular shape, a substantially triangular shape, or is trianguloid. As the connecting members have a right-angled shape and the area of the cross section of the connecting members is reduced with respect to the one of the hollow conductors, the shape of the void is substantially triangular. Hence, a compact design is provided.

Each hollow conductor bundle may be formed by a main body made in one piece wherein the hollow conductors are formed by channels within the main body. This ensures the required mechanical stability as well as low manufacturing costs as the hollow conductor bundle can be manufactured in one process, for instance an extrusion process. Thus, the hollow conductor bundle may be extruded.

Embodiments of the disclosure further provide a method for manufacturing a hollow conductor system, for example, a hollow conductor system as described above, wherein at least two hollow conductor bundles are provided each having at least two hollow conductors separated by each other via a common intermediate wall, at least two connecting members are provided, the first connecting member is connected with one hollow conductor of each hollow conductor bundle, the second connecting member is connected with another hollow conductor of each hollow conductor bundle wherein a void is provided between the first connecting member and the adjacent second connecting member and/or an adjacent hollow conductor. In addition to the above mentioned advantages, the assembling is improved as only the hollow conductor bundles have to be connected with the connecting members. Thus, it is no more necessary to combine or connect the several individual hollow conductors with each other. Furthermore, the several hollow conductor lines can be established in a lightweight manner.

According to an aspect, each of the hollow conductors and the corresponding connecting members are connected with each other along a connection line. Thus, the connecting members have to be inserted into the hollow conductors of the different hollow conductor bundles. Afterwards, they are connected in the overlapping area such that a connection line is formed. Alternatively, a detachable connection is provided wherein the connection line is provided by the transition line between the hollow conductor and the connecting member being inserted into the hollow conductor.

According to another aspect, the connection line is established by a mechanical and/or chemical connection, for instance by welding, brazing, adhering, screwing and/or riveting. Thus, the connection line can be formed by a soldering, brazing and/or welding seam. Alternatively, an adhesive beam can be used. Furthermore, the connection line can be established by several screws and/or rivets defining a line which corresponds to the connection line. The assembling costs can be reduced due to the connecting techniques.

BRIEF DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawing, wherein:

The FIGURE shows a hollow conductor system according to the disclosure.

DETAILED DESCRIPTION OF THE DISCLOSURE

The detailed description set forth below in connection with the appended drawing, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

In the FIGURE, a hollow conductor system 10 is shown comprising two hollow conductor bundles 12 and 14 and three connecting members 16, 18, and 20.

The first hollow conductor bundle 12 comprises three different hollow conductors 22, 24, and 26 and the second hollow conductor bundle 14 comprises three different hollow conductors 28, 30, and 32. The three different hollow conductors 22, 24, and 26 are separated from each other via intermediate walls 34 and 36 and the three different hollow conductors 28, 30, and 32 are separated from each other via intermediate walls 38 and 40 such that an intermediate wall is provided between two adjacent hollow conductors of each hollow conductor bundle.

In general, the hollow conductor bundles 12 and 14 each comprise a main body 42 and 44 made in one piece such that the hollow conductors 22, 24, 26, 28, 30 and 32 are formed by channels in the main bodies 42 and 44. Accordingly, the intermediate walls 34, 36, 38, and 40 of the hollow conductor bundle 12 and 14 are connected with each other by the walls defining the hollow conductors 22, 24, 26, 28, 30, and 32 inter alia. In other words, the hollow conductors 22, 24, 26, 28, 30, and 32 have pipe-like characteristics.

The hollow conductor bundles 12 and 14 are formed such that the middle hollow conductor 24 and 30 of each hollow conductor bundle 12 and 14 is separated from the adjacent hollow conductors 22 and 26 and 28 and 32 of the same hollow conductor bundle 12 and 14 by two intermediate walls 34 and 36, and 38 and 40, respectively.

For instance, the first intermediate wall 34 is provided between the first hollow conductor 22 and the second hollow conductor 24 of the first hollow conductor bundle 12 wherein the second hollow conductor 24 is also called middle hollow conductor. In addition, the second intermediate wall 36 is provided between the second hollow conductor 24 and the third hollow conductor 26 of the first hollow conductor bundle 12. The second hollow conductor bundle 14 is configured in the same or similar manner.

As shown in the FIGURE, each connecting member 16, 18, and 20 connects one hollow conductor 22, 24, and 26 of the first hollow conductor bundle 12 with the corresponding hollow conductor 28, 30, and 32 of the second hollow conductor bundle 14 such that three different hollow conductor lines 46, 48, and 50 are provided. The hollow conductor lines 46, 48, and 50 are used for transferring electromagnetic waves propagating through the different hollow conductor lines 46, 48, and 50 such that they can be transferred from one point to another point. For instance, electromagnetic waves are guided by the hollow conductor lines 46, 48, and 50 from an antenna system to a certain device via the hollow conductor system 10.

The connecting members 16, 18, and 20 and the hollow conductor bundles 12 and 14, for example, their hollow conductors 22, 24, 26, 28, 30, and 32, are formed such that two voids 52 and 54 occur in the connection area of the connecting members 16, 18, and 20 and the hollow conductor bundles 12 and 14.

The first void 52 is limited by the first connecting member 16, the second hollow conductor 24 of the first hollow conductor bundle 12, the second hollow conductor 30 of the second hollow conductor bundle 14 as well as the second connecting member 18 which connects the second hollow conductors 24 and 30 of both hollow conductor bundles 12 and 14.

The second void 54 is limited by the second connecting member 18, the third hollow conductor 26 of the first hollow conductor bundle 12, the third hollow conductor 32 of the second hollow conductor bundle 14 as well as the third connecting member 20. The third connecting member 20 connects the third hollow conductors 26 and 32 of both hollow conductor bundles 12 and 14.

Generally, the voids 52 and 54 are provided each between one connecting member 16, 18, and 20 and the adjacent connecting member 16, 18, and 20 and/or hollow conductors 22, 24, 26, 28, 30, and 32 being adjacent to those which are connected by the dedicated connecting member 16, 18, and 20.

As shown in the FIGURE, the voids 52 and 54 have a substantially triangular shape due to the design of the connecting members 16, 18, and 20 and the hollow conductor bundles 12 and 14, in particular their hollow conductors 22, 24, 26, 28, 30, and 32.

The voids 52 and 54 ensure that different materials adjoin each other which have different dielectric properties, in particular air and the material of the hollow conductor bundles 12 and 14. Thus, the electrical losses can be reduced when electromagnetic waves propagate through the hollow conductor lines 46, 48, and 50.

Each of the connecting members 16, 18, and 20 is connected with the corresponding hollow conductors 22, 24, 26, 28, 30, and 32 such that a connection line 56, 58, 60, 62, 64, and 66 is provided.

As shown in the FIGURE, the connection lines 56, 58, 62, and 64 provided between the first connecting member 16 and the corresponding first hollow conductors 22 and 28 and the second connecting member 18 and the corresponding second hollow conductors 24 and 30 distinguish from the connection lines 60 and 66 provided between the third connecting member 20 and the corresponding third hollow conductors 26 and 32.

The third connection lines 60 and 66 are ring-shaped since the corresponding third hollow conductors 26 and 32 have a face side being parallel to the cross section of the third hollow conductors 26 and 32. Thus, the face sides of the third hollow conductors 26 and 32 are perpendicular with respect to the axial direction of the third hollow conductors 26 and 32.

In contrast thereto, the other connection lines 56, 58, 62, and 64 of the first and second hollow conductor lines 46, 48 are inclined with respect to the cross section of the first and second hollow conductors 22, 24, 28, and 30 since the face sides of the first and second hollow conductors 22, 24, 28, and 30 of both hollow conductor bundles 12 and 14 are inclined with respect to their axial direction.

In general, the hollow conductors 22, 24, 26, 28, 30, and 32 of their respective hollow conductor bundles 12 and 14 have the same axial direction which corresponds to the propagation direction of the electromagnetic waves within the dedicated hollow conductor bundles 12 and 14, in particular their hollow conductors 22, 24, 26, 28, 30, and 32.

As shown in the FIGURE, the connection lines 56, 58, 62, and 64 between the first and second connecting members 16, 18 and the corresponding hollow conductors 22, 24, 28, and 30 run toward the corresponding voids 52 and 54. Thus, the inserted connecting members 16 and 18 are encircled in an asymmetrical manner by the corresponding hollow conductors 22, 24, 28, and 30 due to their inclined face sides. Accordingly, the sides merging into the voids 52 and 54 are shielded by more material with respect to the opposing sides.

This configuration improves the mechanical stability, in particular with regard to bending stresses, as well as the electromagnetic properties such that the electrical losses are minimized.

As can be seen, the connection lines 56, 58, 62, and 64 are curved as one half of each connection line 56, 58, 62, and 64 is formed as a half circle or a half ring whereas the other half of each connection line 56, 58, 62, and 64 runs toward the corresponding void 52 and 54. For instance, the connection lines 56, 58, 62, and 64 run toward the corresponding void 52 and 54 by a distance being equal to the radius of the corresponding hollow conductor 22, 24, 28, and 30. Generally, the inclined and curved connection lines 56, 58, 62, and 64 are established due to these configurations.

In addition, the intermediate walls 34, 36, 38, and 40 protrude into the corresponding void 52 and 54 at least partly. Particularly, the intermediate walls 34, 36, 38, and 40 adjoining the part of the connection line 56, 58, 62, and 64 which run toward the corresponding void 52 and 54 protrude the dedicated parts of the connection lines 56, 58, 62, and 64. Thus, the voids 52 and 54 are limited by the connecting members 16, 18, and 20 as well as the portions of the intermediate walls 34, 36, 38, and 40 which protrude the parts of the connection lines 56, 58, 62, and 64 running toward the corresponding voids 52 and 54.

As the connecting members 16 and 18 have a substantially right-angled shape, the sides of the connecting members 16 and 18 facing to the outside surrounded by more material due to the inclined connection lines 50, 52, 54, and 56, in particular the inclined face sides of the corresponding hollow conductors 22, 24, 28, and 30.

In some embodiments, the hollow conductors 22, 24, 26, 28, 30, and 32 may have a circular cross section being larger than the one of the connecting members 16, 18, and 20 which can be inserted into the face sides of the hollow conductors 22, 24, 26, 28, 30, and 32.

As the hollow conductors 22, 24, 26, 28, 30, and 32 are separated from each other by the intermediate walls 34, 36, and 40, the hollow conductor bundles 12 and 14 have a shape being similar to a cigar bundle wherein each hollow conductor 22, 24, 26, 28, 30, and 32 corresponds to a cigar due to their round shape.

The hollow conductor system 10 shown in the FIG. 1*s* assembled by providing the hollow conductor bundles 12 and 14 as well as the connecting members 16, 18, and 20. The connecting members 16, 18, and 20 are inserted into the first, second and third hollow conductors 22, 24, 26, 28, 30, and 32 of each hollow conductor bundle 12 and 14, in particular at their face sides, such that the hollow conductors 22, 24, 26, 28, 30, and 32 encircles the connecting members 16, 18, and 20. Then, the hollow conductor lines 46, 48, and 50 are established.

Due to the shape of the hollow conductor bundles 12 and 14 as well as the connecting members 16, 18, and 20, two voids 52 and 54 are provided between connecting members 16, 18, and 20 being adjacent to each other. For instance, the voids 52 and 54 are limited by one connecting member 16 and 18, the neighbored connecting member 18 and 20 as well as the hollow conductors 24, 26, 30, and 32 being adjacent to the hollow conductors 22, 24, 28, and 30 which are connected to the one connecting member 16 and 18.

Afterwards, the connecting members 16, 18, and 20 and the hollow conductor bundles 12 and 14 are connected with each other, in particular their hollow conductors 22, 24, 26, 28, 30, and 32, wherein the connecting members 16, 18 and 20 and the hollow conductor bundles 12 and 14 can be welded, soldered, brazed, adhered, screwed and/or riveted with each other.

Since at least the face sides of the first and second hollow conductors 22, 24, 28 and 30 have an inclined face side with respect to the axial direction of the hollow conductor bundles 12 and 14 or their cross sections, inclined connection lines 56, 58, 62, and 64 are provided. The connection lines 56, 58, 62, and 64 run toward the voids 52 and 54.

In some embodiments, each hollow conductor bundle 12 and 14 may comprise two or more hollow conductors. In some embodiments, each hollow conductor bundle 12 and 14 may comprise three or more hollow conductors. In general, each hollow conductor bundle 12 and 14 may comprise two or more than three hollow conductors.

Accordingly, a multi beam hollow conductor system 10 can be established wherein the electrical losses are minimized. In addition, the mechanical properties are improved such as weight reduction and increased mechanical stability. Furthermore, the manufacturing and assembling efforts are reduced which in turn reduces the costs of the whole hollow conductor system 10.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. The term "about," "approximately," "substantially," "near" etc., means plus or minus 10% of the stated value or condition.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A hollow conductor system comprising at least two hollow conductor bundles and at least a first connecting and a second connecting member, wherein the first connecting member and the second connecting member are adjacent to each other, wherein the at least two hollow conductor bundles, the first connecting member and the second connecting member are separately formed with respect to each other, wherein each hollow conductor bundle comprises at least two hollow conductors separated from each other via a respective common intermediate wall, each connecting member connecting a respective hollow conductor of one of the at least two hollow conductor bundles with a corresponding hollow conductor of the other of the at least two hollow conductor bundles such that a respective hollow conductor line and a corresponding void are provided, wherein the respective void is provided between the first connecting member and the adjacent second connecting member and/or an adjacent hollow conductor, and wherein electromagnetic waves propagate through the respective hollow conductor line such that the electromagnetic waves can be transferred from one point to another point.

2. The hollow conductor system according to claim 1, wherein each of the hollow conductors have a face side, and wherein the first and second connecting members are connected to the corresponding hollow conductors at the face sides thereof.

3. The hollow conductor system according to claim 1, wherein the first and second connecting members are inserted into the corresponding hollow conductors such that the respective hollow conductors at least partially surround the corresponding connecting members.

4. The hollow conductor system according to claim 1, wherein at least one hollow conductor has an inclined face side with respect to an axial direction of the at least one hollow conductor.

5. The hollow conductor system according to claim 1, wherein a respective connection line is provided between each connecting member and the respective hollow conductor connected to the corresponding connecting member.

6. The hollow conductor system according to claim 5, wherein the respective connection line encloses a complete area of the cross section of the corresponding connecting member.

7. The hollow conductor system according to claim 5, wherein an area assigned to the respective connection line is inclined with respect to the cross section of the respective hollow conductor.

8. The hollow conductor system according to claim 5, wherein the respective connection line extends toward the corresponding void.

9. The hollow conductor system according to claim 1, wherein the respective void has a generally triangular shape.

10. The hollow conductor system according to claim 1, wherein said at least two hollow conductors of each hollow conductor bundle comprises at least three hollow conductors, and wherein at least three connecting members being provided such that at least two voids are provided between each neighboring connecting members.

11. The hollow conductor system according to claim 1, wherein at least one of the first connecting member and the second connecting member has a right-angled shape.

12. The hollow conductor system according to claim 1, wherein each hollow conductor bundle is formed by a respective main body made in one piece, the respective hollow conductors being formed by channels within the respective main bodies.

13. A method for assembling a hollow conductor system comprising the following steps:

providing at least a first hollow conductor bundle and a second hollow conductor bundle each having at least a first hollow conductor and a second hollow conductor separated from each other via a respective common intermediate wall;

providing at least a first connecting member and a second connecting member, wherein the first connecting member and the second connecting member are separately formed with respect to each other and with respect to the at least the first and second hollow conductor bundles;

connecting the first connecting member with the first hollow conductor of each hollow conductor bundle; and connecting the second connecting member with the second hollow conductor of each hollow conductor bundle so that the second connecting member is adjacent to the first connecting member, wherein a void is provided between the first connecting member and the adjacent second connecting member and/or an adjacent hollow conductor.

14. The method according to claim 13, wherein each of the hollow conductors and the corresponding connecting members are connected with each other along a connection line.

15. The method according to claim 13, wherein the connection line is established by a mechanical and/or chemical connection.

16. The method according to claim 15, wherein the chemical connection includes adhering.

17. The method according to claim 15, wherein the mechanical connection includes one of welding, brazing, soldering, screwing, or riveting.

* * * * *